US008174492B2

(12) United States Patent
Kim et al.

(10) Patent No.: US 8,174,492 B2
(45) Date of Patent: May 8, 2012

(54) METHOD FOR DRIVING AN ELECTROPHORETIC DISPLAY

(75) Inventors: Joo-Young Kim, Suwon-si (KR); Cheol-Woo Park, Suwon-si (KR); Ho-Yong Jung, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 1028 days.

(21) Appl. No.: 12/121,603

(22) Filed: May 15, 2008

(65) Prior Publication Data

US 2009/0058846 A1 Mar. 5, 2009

(30) Foreign Application Priority Data

Sep. 5, 2007 (KR) ..... 10-2007-0089957

(51) Int. Cl.
*G09G 3/34* (2006.01)

(52) U.S. Cl. ..... 345/107; 359/296; 345/204; 345/690

(58) Field of Classification Search ..... 345/105, 345/107, 204, 208, 690, 214; 359/296
See application file for complete search history.

(56) References Cited

U.S. PATENT DOCUMENTS

| | | | | |
|---|---|---|---|---|
| 6,671,081 | B2 * | 12/2003 | Kawai | 359/296 |
| 2005/0179641 | A1 * | 8/2005 | Zhou et al. | 345/107 |
| 2006/0132426 | A1 * | 6/2006 | Johnson | 345/107 |
| 2006/0164405 | A1 * | 7/2006 | Zhou | 345/204 |
| 2006/0274030 | A1 * | 12/2006 | Johnson et al. | 345/107 |
| 2007/0052667 | A1 * | 3/2007 | Zhou et al. | 345/107 |
| 2007/0273637 | A1 * | 11/2007 | Zhou et al. | 345/107 |
| 2008/0165120 | A1 * | 7/2008 | Johnson | 345/107 |

FOREIGN PATENT DOCUMENTS

| | | |
|---|---|---|
| JP | 2004-271609 | 9/2004 |
| JP | 2005-283820 | 10/2005 |
| JP | 2007-065258 | 3/2007 |
| JP | 2007-163987 | 6/2007 |
| KR | 1020050024444 | 3/2005 |
| KR | 1020050116160 | 12/2005 |
| KR | 1020060066999 | 6/2006 |
| KR | 1020060097128 | 9/2006 |
| KR | 1020060105755 | 10/2006 |

* cited by examiner

*Primary Examiner* — Lun-Yi Lao
*Assistant Examiner* — Tom Sheng
(74) *Attorney, Agent, or Firm* — Innovation Counsel LLP

(57) ABSTRACT

The display of after-images is prevented in an electrophoretic display by applying one gray of at least three different grays through at least some of the pixels, applying a middle gray through at least some of the plurality of pixels, and applying a final compensation voltage to refresh the plurality of pixels.

20 Claims, 17 Drawing Sheets

METHOD FOR DRIVING AN ELECTROPHORETIC DISPLAY

CROSS-REFERENCE TO RELATED APPLICATION

This application claims priority to and the benefit of Korean Patent Application No. 10-2007-0089957 filed in the Korean Intellectual Property Office on Sep. 5, 2007, the entire contents of which are incorporated herein by reference.

BACKGROUND OF THE INVENTION

1. Field of the Invention

The present invention relates to a method for driving an electrophoretic display that displays images through position changes of electrophoretic particles.

2. Description of the Related Art

The electrophoretic display includes a thin film transistor array panel having pixel electrodes each connected to a thin film transistor, a common electrode panel including a common electrode, and positive or negatively charged electrophoretic particles that move between the pixel electrodes and the common electrode.

A common reference voltage is applied to the common electrode and data voltages that are larger or smaller than the common voltage are applied to the pixel electrodes according to gray information. Differences between the common voltage and the data voltages are applied to the electrophoretic particles as image display voltages of positive or negative polarity causing the electrophoretic particles to move to the pixel electrodes or the common electrode. The distance that the electrophoretic particles move is determined by the application time of the image display voltages which is based on the gray information for each pixel resulting in disposition of the electrophoretic particles at various positions between the pixel electrodes and the common electrode.

However, if the image display voltages are repeatedly applied to the electrophoretic particles, arbitrary charges are stimulated in each pixel such that afterimages may be generated. Accordingly, each pixel must be refreshed through the application of a compensation voltage to remove the stimulated charges for the prevention of the afterimage. After the desired image is displayed for a predetermined time the compensation voltage of the same value but of opposite polarity to the image display voltage is applied for the predetermined time to display a compensation image which is the reverse of the desired image.

The display of the compensation image between displays of the desired images degrades the performance of the electrophoretic display delays the image display because of the finite speed of the electrophoretic particles.

SUMMARY OF THE INVENTION

According to an aspect of the present invention the performance of an electrophoretic display is improved by applying an image display voltage having a predetermined magnitude to display one gray of at least three different grays to at least a portion of a plurality of pixels, applying a middle gray display voltage having a predetermined magnitude to display the same middle grays to at least a portion of the plurality of pixels, and applying a final compensation voltage having a predetermined voltage to refresh the plurality of pixels.

The method of the invention may further include applying a reset voltage to the plurality of pixels, and applying a reset compensation voltage having the opposite polarity to that of the reset voltage to the plurality of pixels before applying the image display voltage.

The method of the invention may further include an interval of maintaining the images displayed in the plurality of pixels between the application of the image display voltage and the application of the middle gray display voltage.

The plurality of pixels may display the image of the lowest or the highest gray through the applying of the final compensation voltage.

The time-integrated value of the image display voltage is substantially the same as the sum of the time-integrated value of the middle gray display voltage and the final compensation voltage for a portion of the pixels and the time-integrated value of the image display voltage is substantially the same as the time-integrated value of the final compensation voltage for the rest of the pixels.

The middle gray display voltage and the final compensation voltage may have opposite polarities to that of the image display voltage for pixel being applied with the image display voltage.

The value reached by the middle gray display voltage integrated over its corresponding application time may be substantially the same as the value reached by the final compensation voltage integrated over its corresponding application time for the pixel not having the image display voltage applied.

The final compensation voltage may have the opposite polarity to that of the middle gray display voltage for pixel not having the image display voltage applied.

The plurality of pixels may display the image of the lowest gray through the application of the reset voltage, may respectively display the image of the highest gray through the application of the reset compensation voltage, and may respectively display the image of at least one of the lowest gray, the highest gray, and an intermediate gray between the lowest gray and the highest gray through the application of the image display voltage.

The plurality of pixels may respectively display the image of one gray of the lowest gray, a first intermediate gray, a second intermediate gray that is higher than the first intermediate gray, and the highest gray through the application of the image display voltage.

DETAILED DESCRIPTION OF THE EMBODIMENTS

An electrophoretic display will be described in detail with reference to FIG. 1 to FIG. 2 before the explanation of the method for driving the electrophoretic display according to the exemplary embodiment of the present invention.

Figure 1:
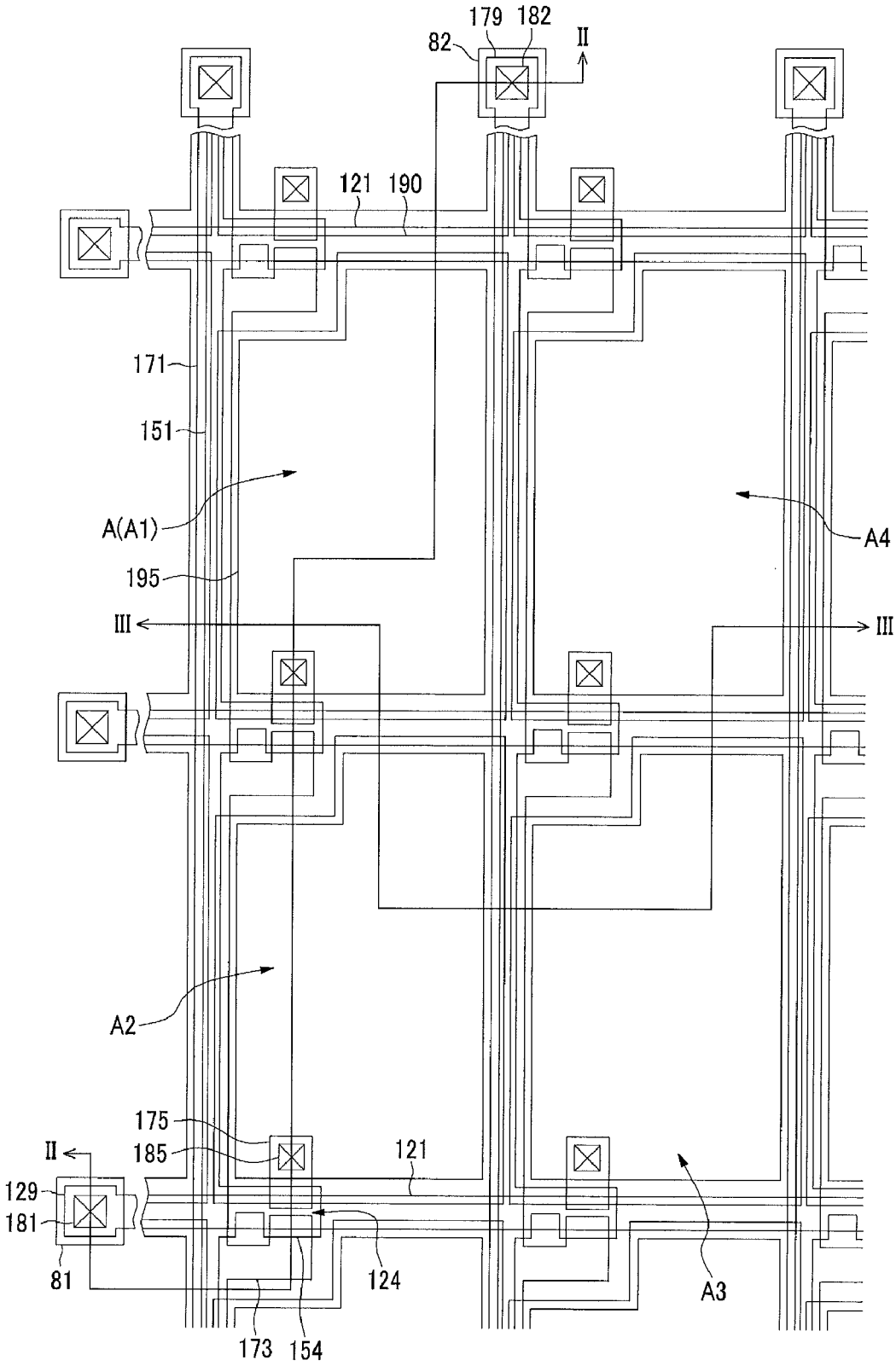
FIG. 1 is a layout of an electrophoretic display driven by a method for driving the electrophoretic display according to an exemplary embodiment of the present invention.
Figure 2:
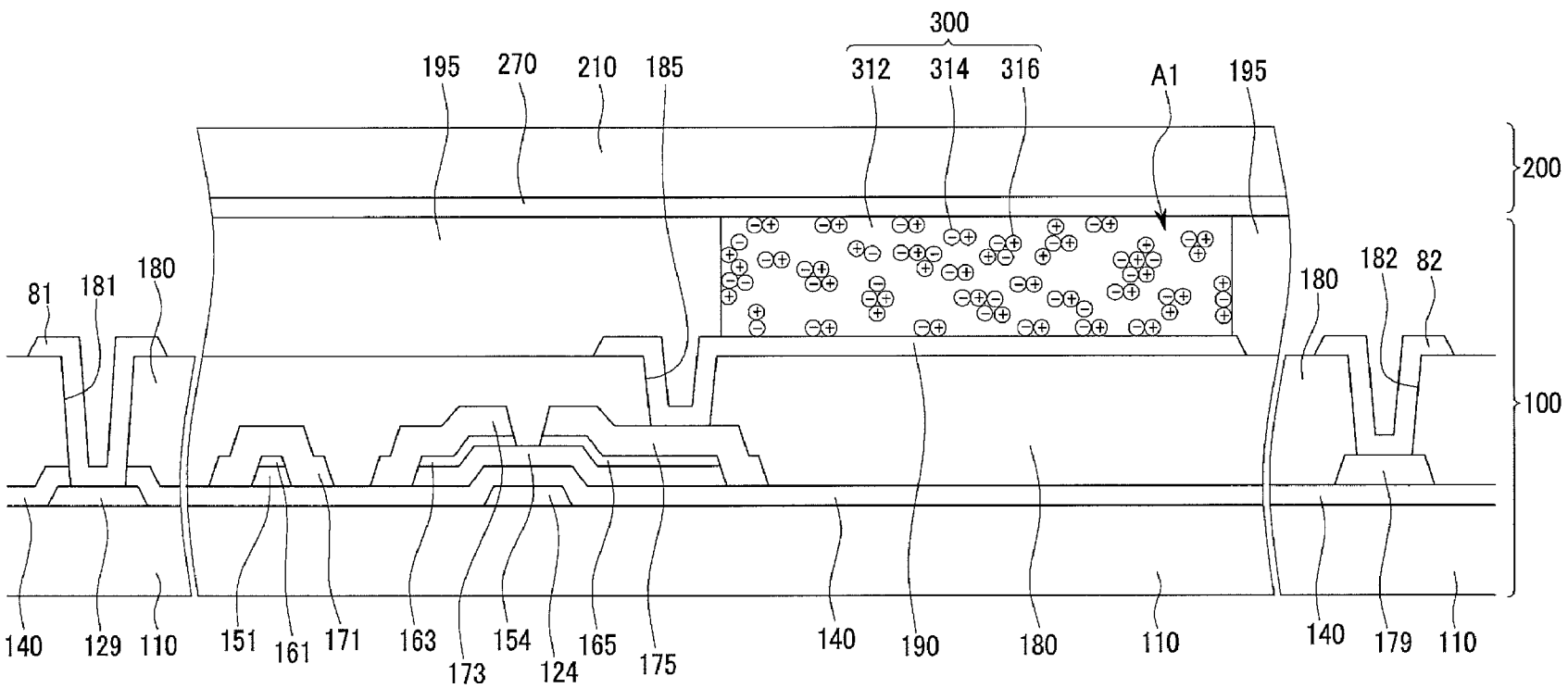
FIG. 2 is a cross-sectional view of the electrophoretic display shown in FIG. 1 taken along the line II-II.

FIG. 1 is a layout of an electrophoretic display driven by a method according to an exemplary embodiment of the present invention, and FIG. 2 is a cross-sectional view of the electrophoretic display shown in FIG. 1 taken along the line II-II.

An electrophoretic display includes a thin film transistor array panel 100, a common electrode panel 200 facing the thin film transistor array panel 100, and an electrophoretic layer 300 disposed in each pixel A between the display panels 100 and 200.

Referring to FIG. 1 to FIG. 2, a plurality of gate lines 121 for transmitting gate signals are formed on an insulating substrate 110, which is preferably made of transparent glass or plastic The gate lines 121 extend substantially in a transverse direction, and each gate line 121 includes a plurality of gate electrodes 124 and an end portion 129 having a large area for connection with another layer or an external driving circuit.

A gate insulating layer 140 made of silicon nitride SiNx is formed on the gate lines 121.

A plurality of semiconductor stripes 151 made of hydrogenated amorphous silicon a-Si are formed on the gate insulating layer 140. The semiconductor stripes 151 extend in a vertical direction, and include a plurality of protrusions 154 extended toward the gate electrodes 124. Also, the semiconductor stripes 151 have a width that widens near the gate lines 121, and widely cover the gate lines 121.

A plurality of ohmic contact stripes and islands 161 and 165 preferably made of a material such as n+ hydrogenated amorphous silicon in which an n-type impurity such as phosphor is doped with a high density, or of silicide, are formed on the semiconductor strips 151. The ohmic contact stripes 161 include a plurality of protrusions 163, and the protrusions 163 and the ohmic contact islands 165 are provided in pairs on the protrusions 154 of the semiconductor stripes 151.

A plurality of data lines 171 and a plurality of drain electrodes 175 are formed on the ohmic contacts 163 and 165, and on the gate insulating layer 140.

The data lines 171 are used to transmit data signals, and extend substantially in a vertical direction so as to cross the gate lines 121. Each of the data lines 171 includes a plurality of source electrodes 173 extending toward the gate electrodes 124 and curved with a "J" shape, and an end portion 179 having a large area so as to be connected to another layer or an external driving circuit. A pair of a source electrode 173 and a drain electrode 175 are separated from each other and disposed at opposite sides with respect to the gate electrodes 124.

A gate electrode 124, a source electrode 173, a drain electrode 175, and a protrusion 154 of the semiconductor stripes 151 form a thin film transistor (TFT), and a channel of the thin film transistor is provided to the protrusions 154 between the source electrode 173 and the drain electrode 175.

The ohmic contacts 161 and 165 are interposed between the underlying semiconductor stripes 151 and the overlying data lines 171 and the overlying drain electrodes 175 thereon, and reduce the contact resistance therebetween.

The semiconductor stripes 151 include a plurality of exposed portions, which are not covered with the data lines 171 and the drain electrodes 175, such as portions located between the source electrodes 173 and the drain electrodes 175. Although the semiconductor stripes 151 are narrower than the data lines 171 at most places, the width of the semiconductor stripes 151 becomes large near the gate lines as described above, to enhance the insulation between the gate lines 121 and the data lines 171.

A passivation layer 180 is formed in a single-layered or multi-layered structure on the data lines 171, the drain electrodes 175, and the exposed portions of the semiconductor stripes 151. The passivation layer 180 is preferably made of a photosensitive organic material having a good flatness characteristic, a low dielectric insulating material such as a-Si:C:O and a-Si:O:F formed by plasma enhanced chemical vapor deposition (PECVD), or an inorganic material such as silicon nitride. For example, if the passivation layer 180 is formed of an organic material, to prevent the organic material of the passivation layer 180 from contacting with the semiconductor stripes 151 exposed between the data lines 171 and the drain electrodes 175, the passivation layer 180 can be structured in such a way that an insulating layer (not shown) made of SiNx or SiO2 is additionally formed under the organic material layer.

The passivation layer 180 has a plurality of contact holes 181, 185, and 182 exposing the end portions 129 of the gate lines 121 and the end portions 179 of the drain electrodes 175 and the data lines 171, respectively.

A plurality of pixel electrodes 190 and a plurality of contact assistants 81 and 82, which are preferably made of ITO, IZO or an opaque metal, are formed on the passivation layer 180.

The pixel electrodes 190 are physically and electrically connected to the drain electrodes 175 through the contact holes 185 such that the pixel electrodes 190 receive the data voltages from the drain electrodes 175 to apply a data voltage to the electrophoretic layer 300.

The contact assistants 81 and 82 are respectively connected to the exposed end portions 129 and 179 of the gate lines 121 and the data lines 171 through the contact holes 181 and 182. The contact assistants 81 and 82 protect the exposed end portions of the gate lines 121 and the data lines 171, and complement the adhesion between the exposed portions and external devices such as a driving integrated circuit.

A plurality of partitions 195 including at least one of an organic insulator material and an inorganic insulator material and disposed between the pixel electrodes 190 are formed on the passivation layer 180. The partitions 195 surround the peripheries of the pixel electrodes 190 to define a plurality of pixels A wherein the electrophoretic layer 300 is filled.

For better comprehension and ease of description, the pixels A are shown as four neighboring pixels A1, A2, A3, and A4, but four neighboring pixels A1, A2, A3, and A4 may be repeatedly provided in the horizontal or vertical direction in the thin film transistor array panel 100.

Next, the common electrode panel 200 will be described.

The common electrode panel 200 is opposed to the thin film transistor array panel 100, and includes a transparent insulating substrate 210 and a common electrode 270 formed on the insulating substrate 210 and facing the pixel electrodes 190.

The common electrode 270 is a transparent electrode made of ITO or IZO, and applies a common voltage to respective electrophoretic particles 314 and 316 of the electrophoretic layer 300.

The common electrode 270 applying a common voltage changes the positions of the electrophoretic particles 314 and 316 by applying an image display voltage to the respective electrophoretic particles 314 and 316 along with the pixel electrodes 190 applying a data voltage, thereby displaying images of various grays.

Next, the electrophoretic layer 300 disposed in each pixel A will be described.

The electrophoretic layer 300 includes the first electrophoretic particles 314, which are colored white and charged with negative charges, the second electrophoretic particles 316, which are colored black and charged with positive charges, and a transparent dielectric fluid 312 in which the electrophoretic particles 314 and 314 are dispersed. In additional, the electrophoretic layer 300 may include micro-capsules enclosing the electrophoretic particles 314 and 316 and the transparent dielectric fluid 312, and the partitions 195 provided in the thin film transistor array panel 100 may be omitted. Also, the first electrophoretic particles 314 and the second electrophoretic particles 316 may be charged with positive charges and negative charges, respectively, opposite to the above description.

Next, methods for displaying the images of different grays in each of four pixels A of the electrophoretic display according to an exemplary embodiment of the present invention will be described with the reference to FIG. 3 and FIG. 4.

Figure 3:
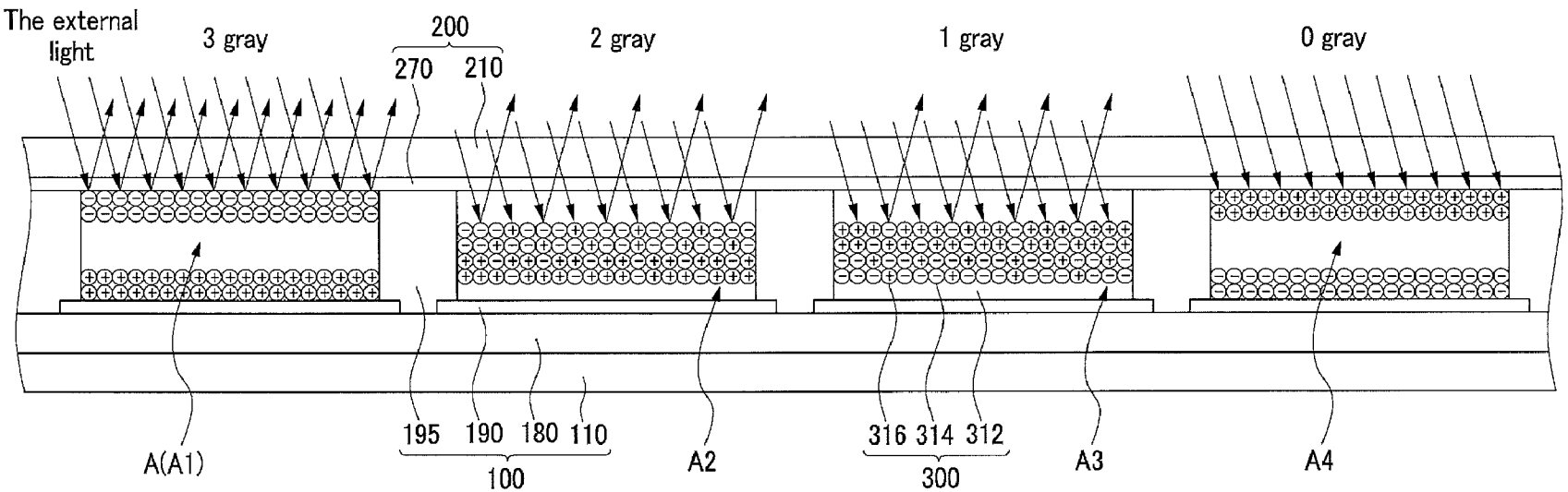
FIG. 3 is a cross-sectional view of the electrophoretic display shown in FIG. 1 taken along the line III-III to explain a method for respectively displaying the images of four pixels.
Figure 4:
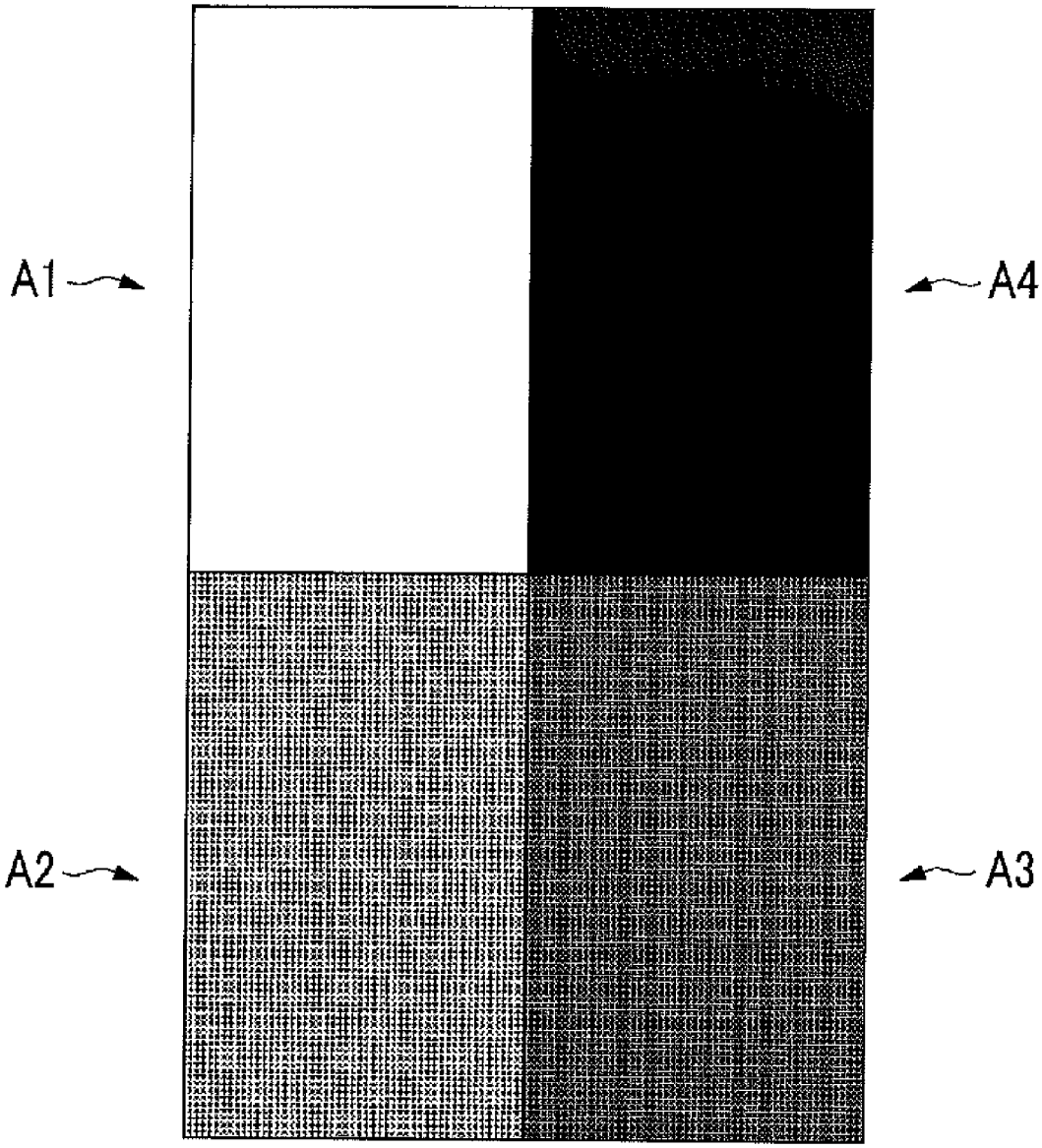
FIG. 4 is a view showing the images of four neighboring pixels in the electrophoretic display of FIG. 3.

FIG. 3 is a cross-sectional view of the electrophoretic display shown in FIG. 1 taken along the line III-III to explain a method for respectively displaying the images of four pixels, and FIG. 4 is a view showing the images of four neighboring pixels in the electrophoretic display of FIG. 3.

As shown in FIG. 3, the electrophoretic particles 314 and 316 have four different arrangements between the pixel electrodes 190 and the common electrode 270 according to the time for applying the driving voltages that correspond to a difference between the common voltage applied to the common electrode 270 and the data voltage applied to the pixel electrodes 270 to the electrophoretic particles 314 and 316 disposed in each pixel A1, A2, A3, and A4.

The first electrophoretic particles 314 in the first pixel A1 are arranged close to the common electrode 270, and the second electrophoretic particles 316 are arranged close to the pixel electrode 190. Accordingly, most of the light incident on the first pixel A1 from the outside is reflected by the first electrophoretic particles 314. Therefore, as shown in FIG. 4, the first pixel A1 displays the third gray image having the brightest white of the highest gray.

On the other hand, the first and second electrophoretic particles 314 and 316 in the second pixel A2 are disposed between pixel electrode 190 and the common electrode 270, the most of the first electrophoretic particles 314 are disposed closer to the common electrode 270 than the second electrophoretic particles 316. Accordingly, a large amount of the external light incident on the second pixel A2 from the outside is reflected by the first electrophoretic particles 314 of the white color, and a small amount the external light is absorbed by the second electrophoretic particles 316 of the black color. Therefore, as shown in FIG. 4, the second pixel A2 displays the second gray image of a middle gray that is darker than the third gray image and has a weak ash color.

Also, the first and second electrophoretic particles 314 and 316 in the third pixel A3 are disposed between the pixel electrode 190 and the common electrode 270, but most of the second electrophoretic particles 316 are arranged closer to the common electrode 270 than are the first electrophoretic particles 314, differently from in the second pixel A2. Accordingly, a small amount of the external light incident on the third pixel A3 from the outside is reflected by the first electrophoretic particles 314 with a white color, and a large amount of the external light is absorbed by the second electrophoretic particles 316 with a black color. Therefore, as shown in FIG. 4, the third pixel A3 displays the first gray image that is darker than the second gray and is a hard ash color of a middle gray.

On the other hand, the first electrophoretic particles 314 in the fourth pixel A4 are disposed close to the pixel electrode 190, and the second electrophoretic particles 316 are disposed close to the common electrode 270. Accordingly, most of the external light incident on the fourth pixel A4 is absorbed by the second electrophoretic particles 316 with a black color. Therefore, as shown in FIG. 4, the fourth pixel A4 displays the zero gray image that is the lowest gray and is the darkest color.

It is possible for the electrophoretic particles 314 and 316 to be disposed in each pixel A1, A2, A3, and A4 with four different arrangements to what are described above. Accordingly, each pixel A1, A2, A3, and A4 may display arbitrary desired images. On the other hand, if the time for applying the driving voltage to drive the electrophoretic particles 314 and 316 is appropriately controlled, the electrophoretic particles 314 and 316 disposed in each pixel A1, A2, A3, and A4 may be arranged in more than four different positions. Accordingly, each pixel A1, A2, A3, and A4 may display images of more than four various grays, for example 16 grays or 32 grays.

Now, driving methods of the electrophoretic display according to an exemplary embodiment of the present invention will be described in detail with reference to FIG. 5 to FIG. 17.

Figure 5:
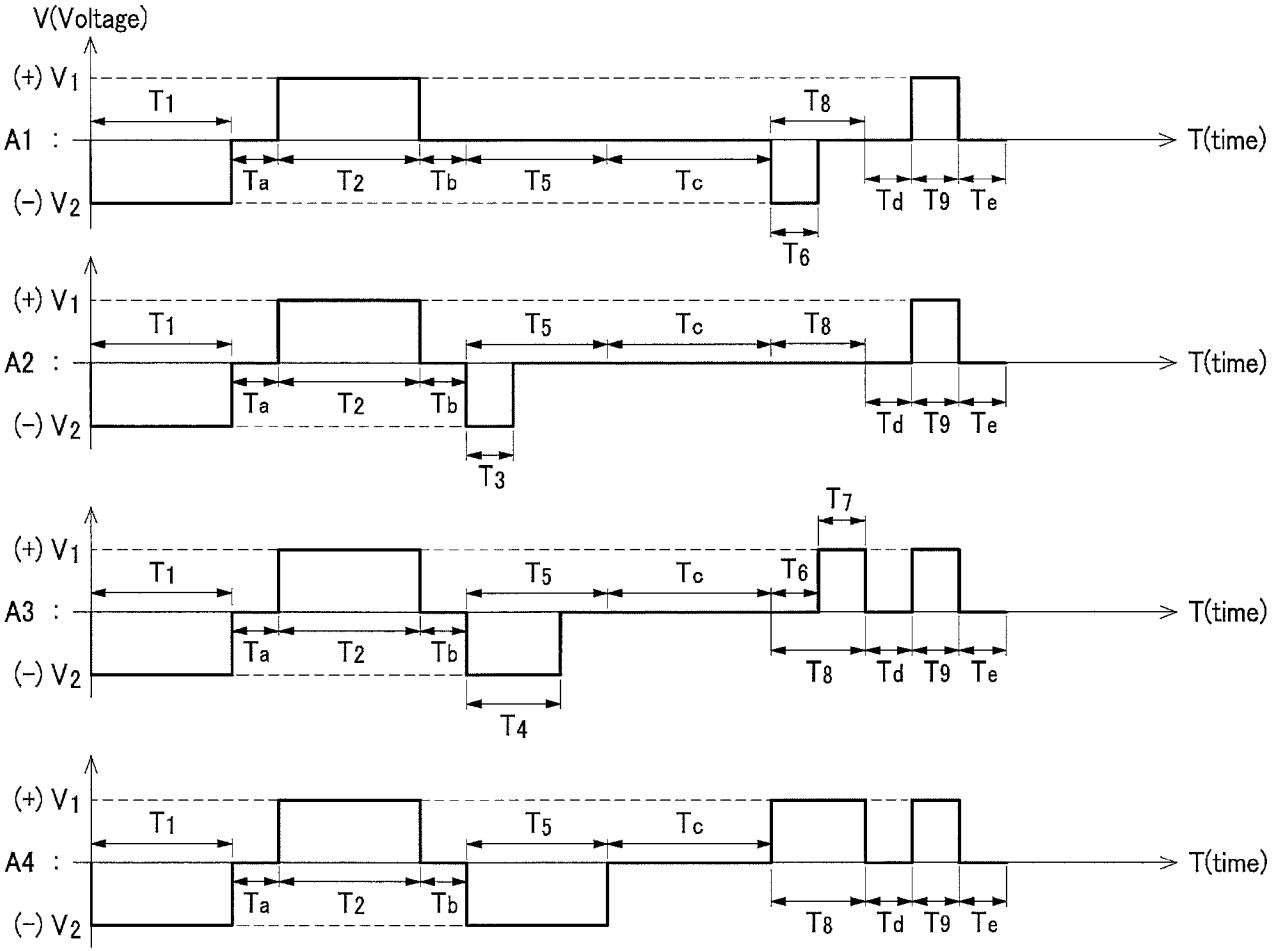
FIG. 5 is a view showing driving voltages applied to the electrophoretic particles disposed in the four neighboring pixels by time to explain a method for driving an electrophoretic display according to an exemplary embodiment of the present invention.
Figure 6:
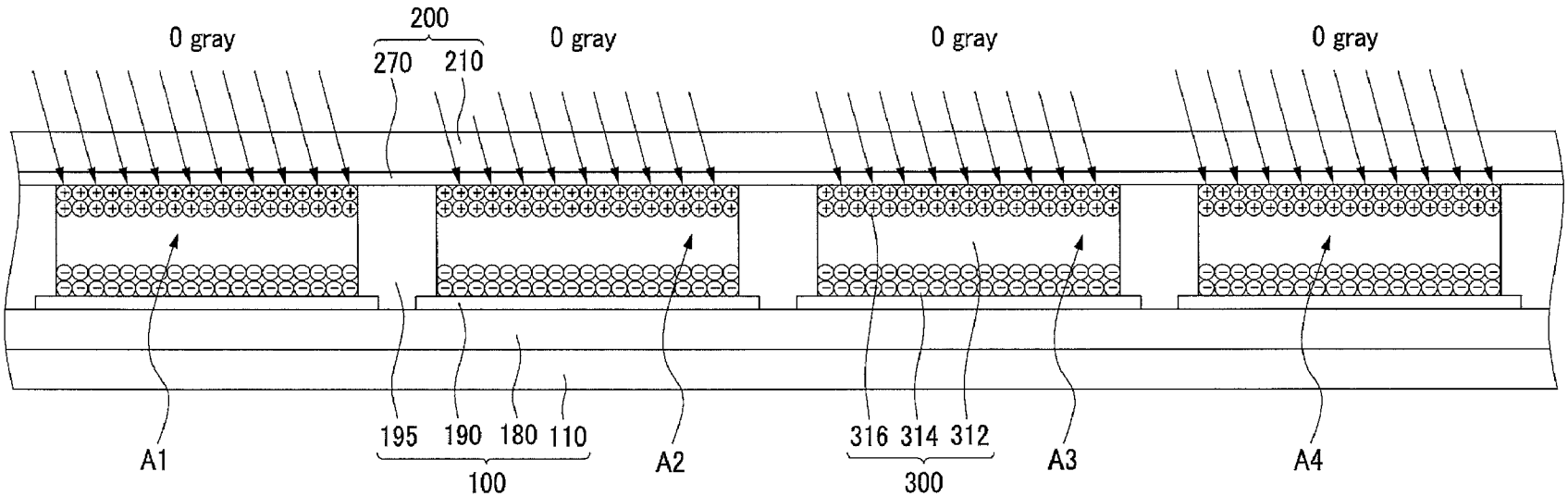
FIG. 6 is a cross-sectional view showing the movement of the electrophoretic particles disposed in four pixels after the passage of the first time of FIG. 5.
Figure 7:
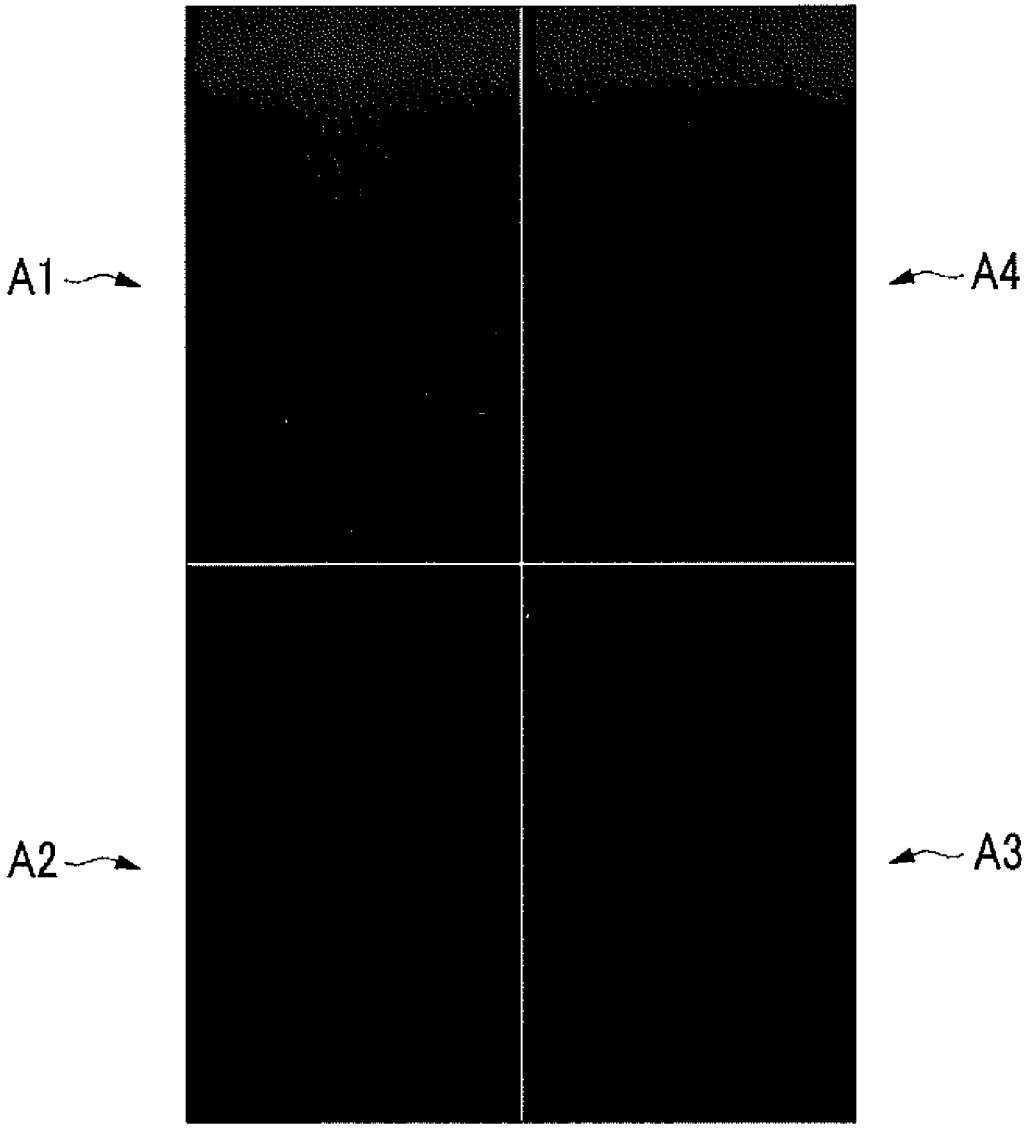
FIG. 7 is a view showing the images of four neighboring pixels in the electrophoretic display of FIG. 6.
Figure 8:
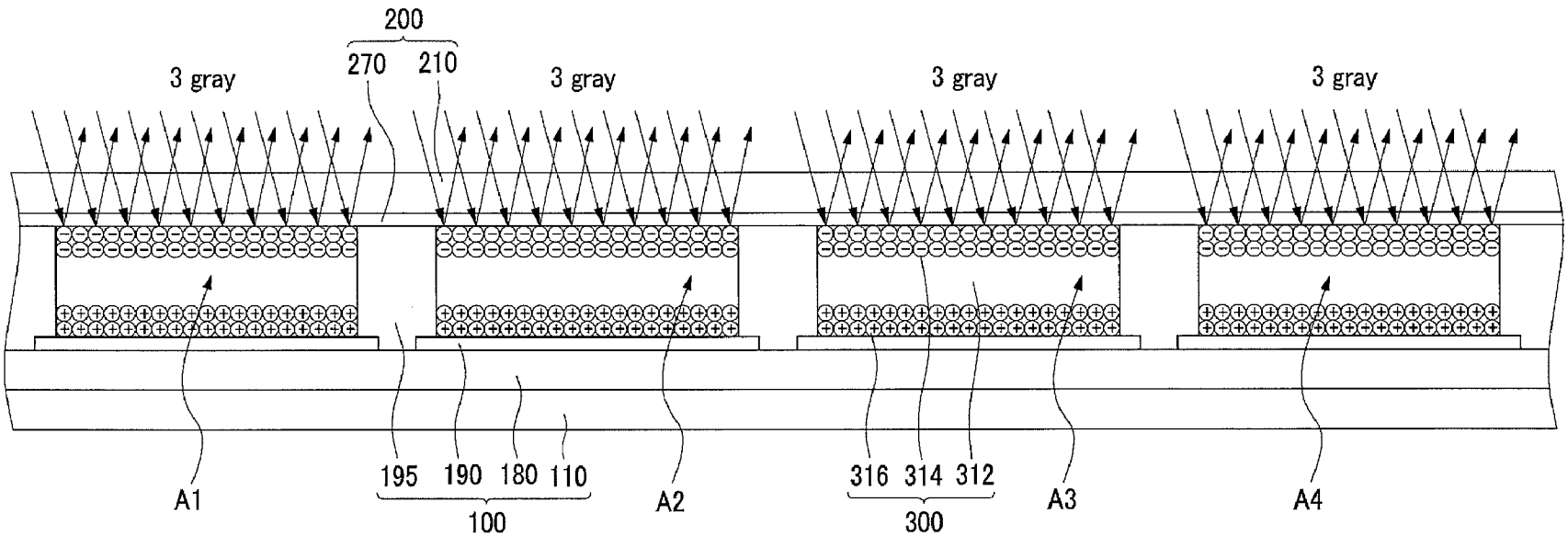
FIG. 8 is a cross-sectional view showing the movement of the electrophoretic particles disposed in four pixels after the passage of the second time of FIG. 5.
Figure 9:
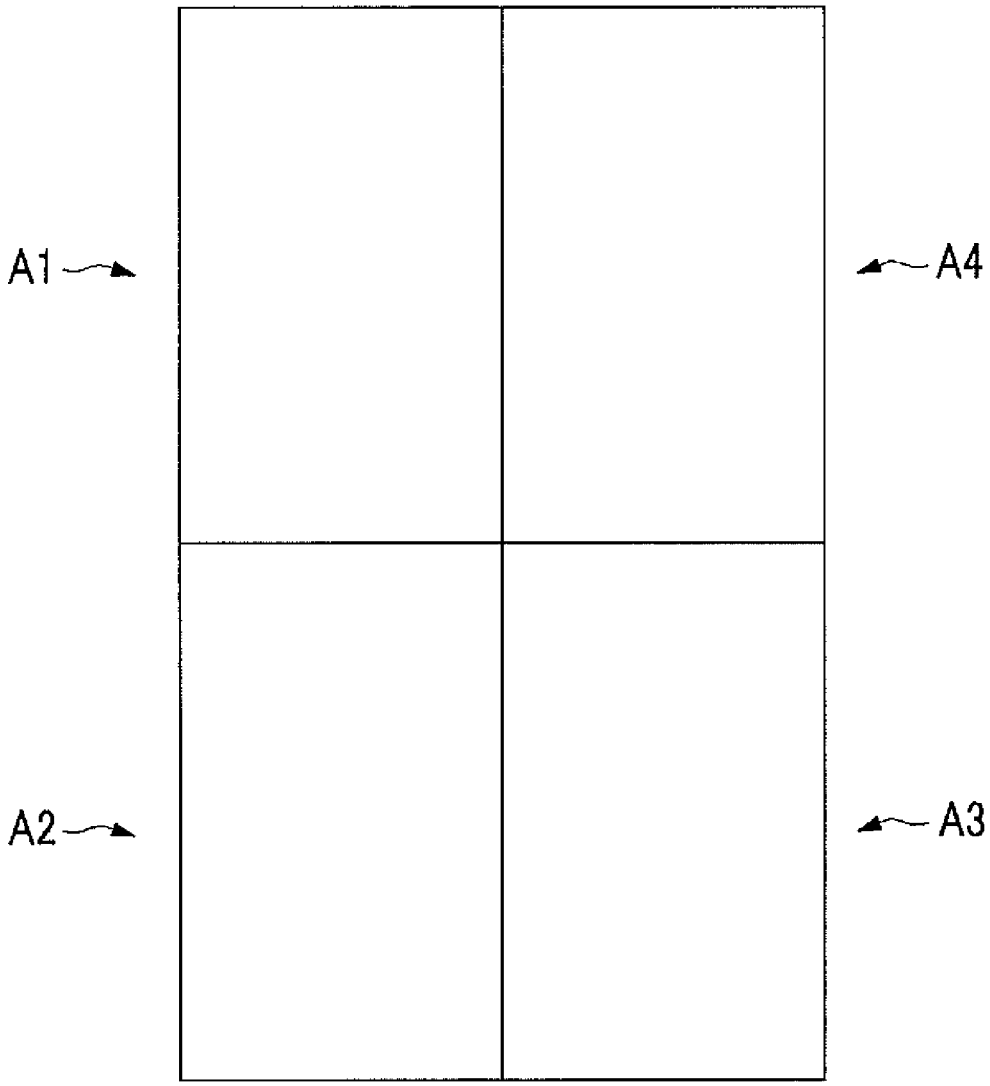
FIG. 9 is a view showing the images of four neighboring pixels in the electrophoretic display of FIG. 8.
Figure 10:
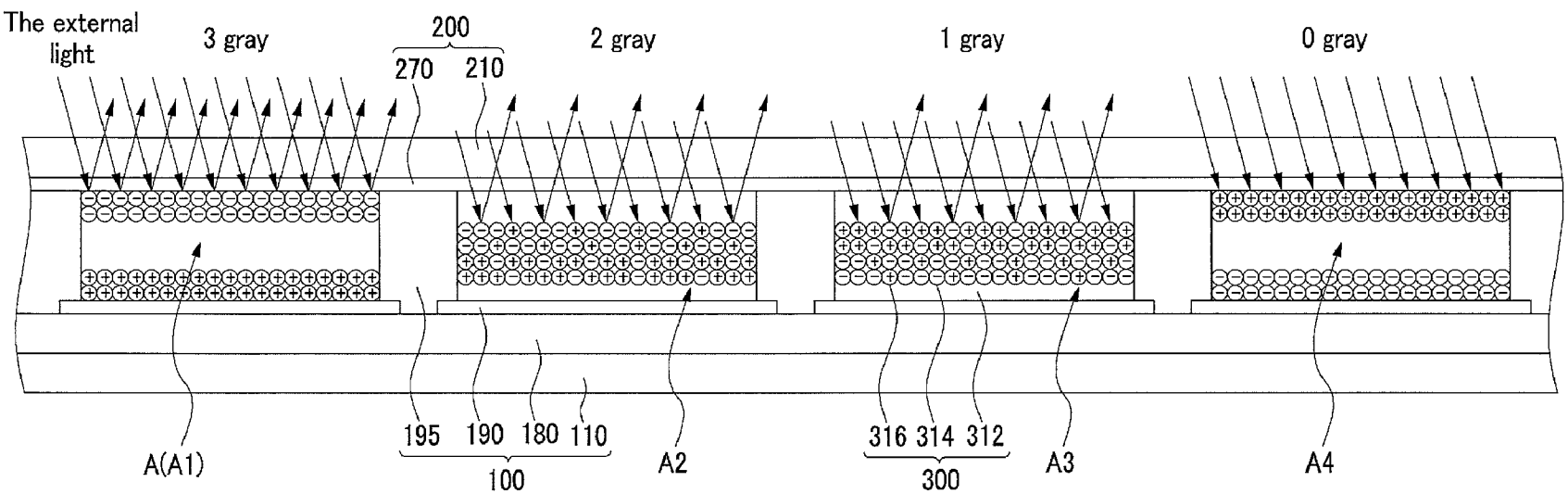
FIG. 10 is a cross-sectional view showing the movement of the electrophoretic particles disposed in four pixels after the passage of the fifth time of FIG. 5.
Figure 11:
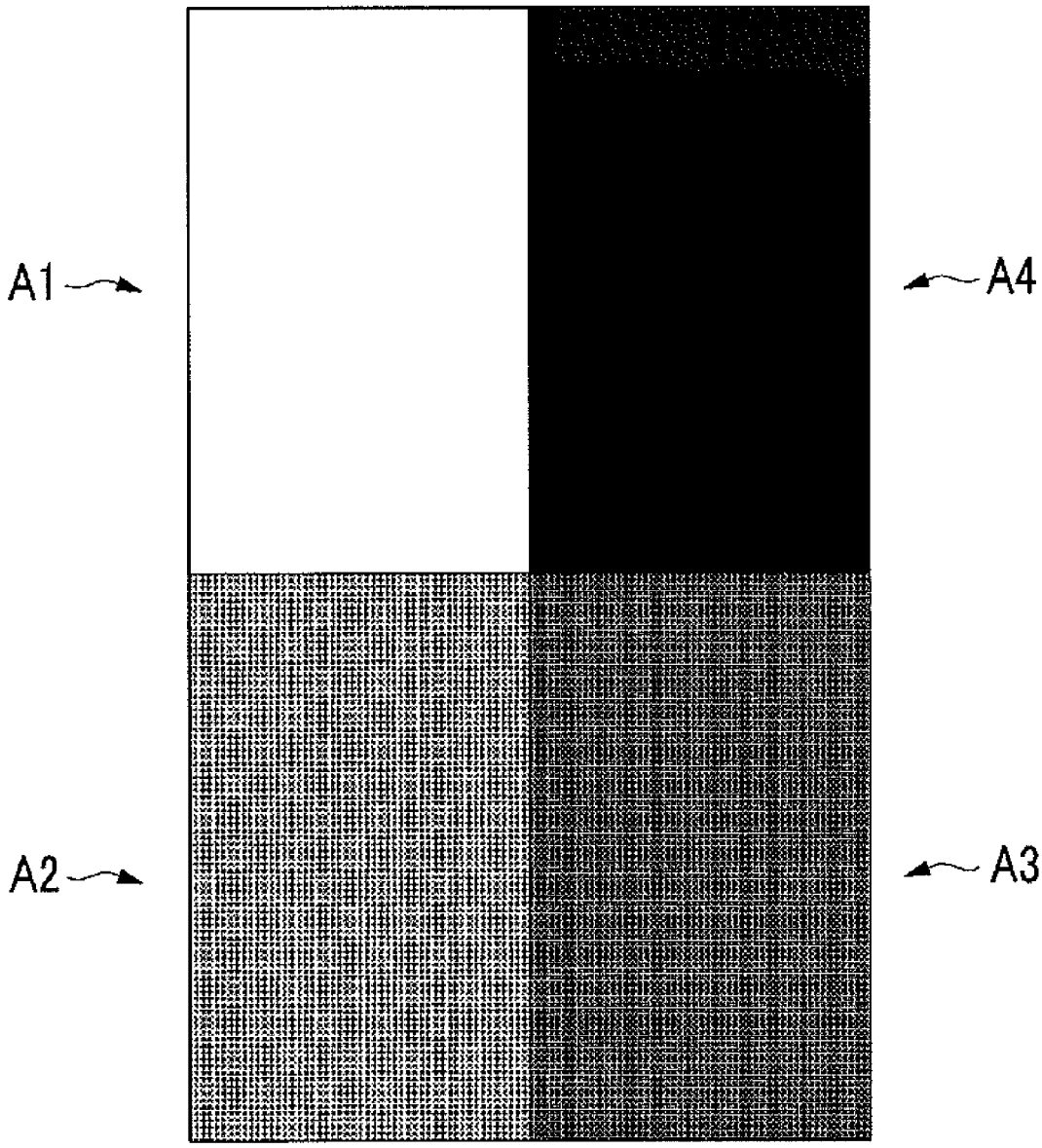
FIG. 11 is a view showing the images of four neighboring pixels in the electrophoretic display of FIG. 10.
Figure 12:
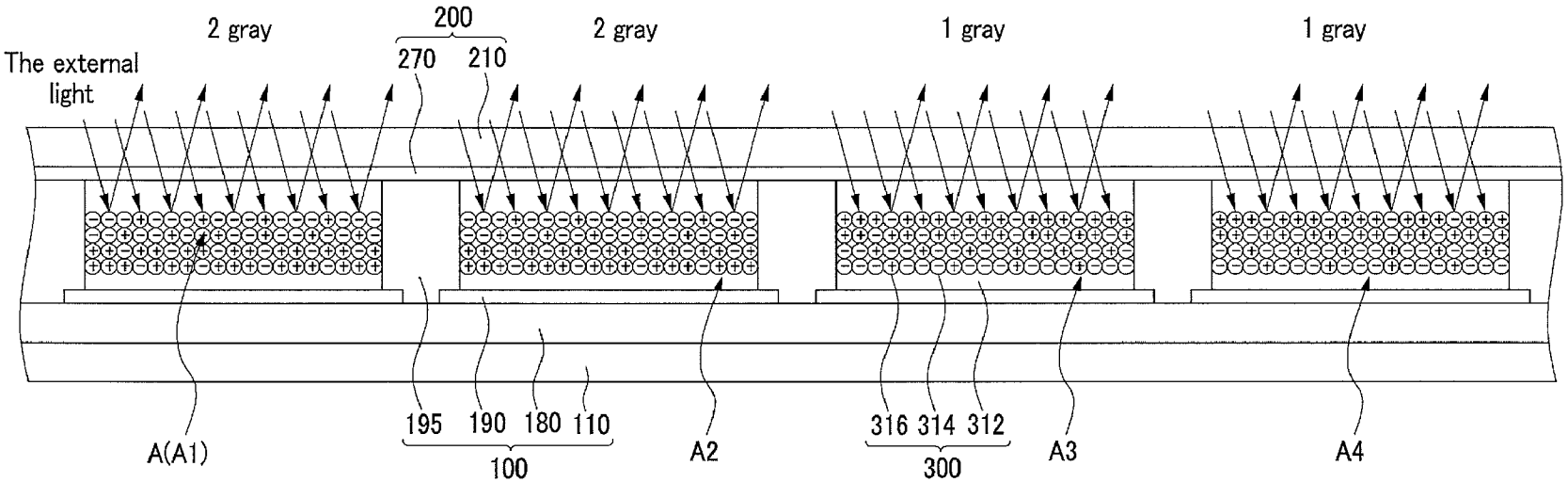
FIG. 12 is a cross-sectional view showing the movement of the electrophoretic particles disposed in four pixels after the passage of the sixth time of FIG. 5.
Figure 13:
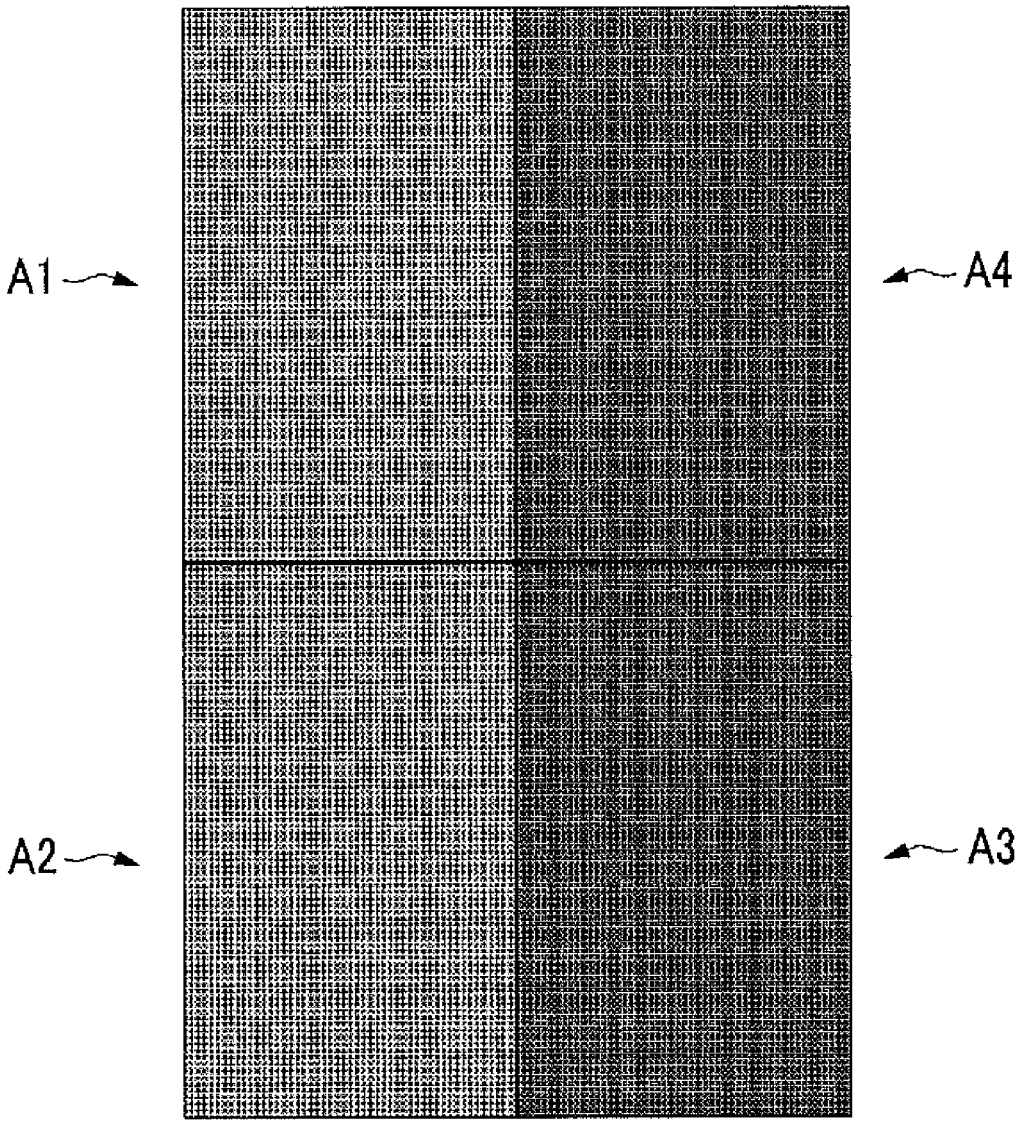
FIG. 13 is a view showing the images of four neighboring pixels in the electrophoretic display of FIG. 12.
Figure 14:
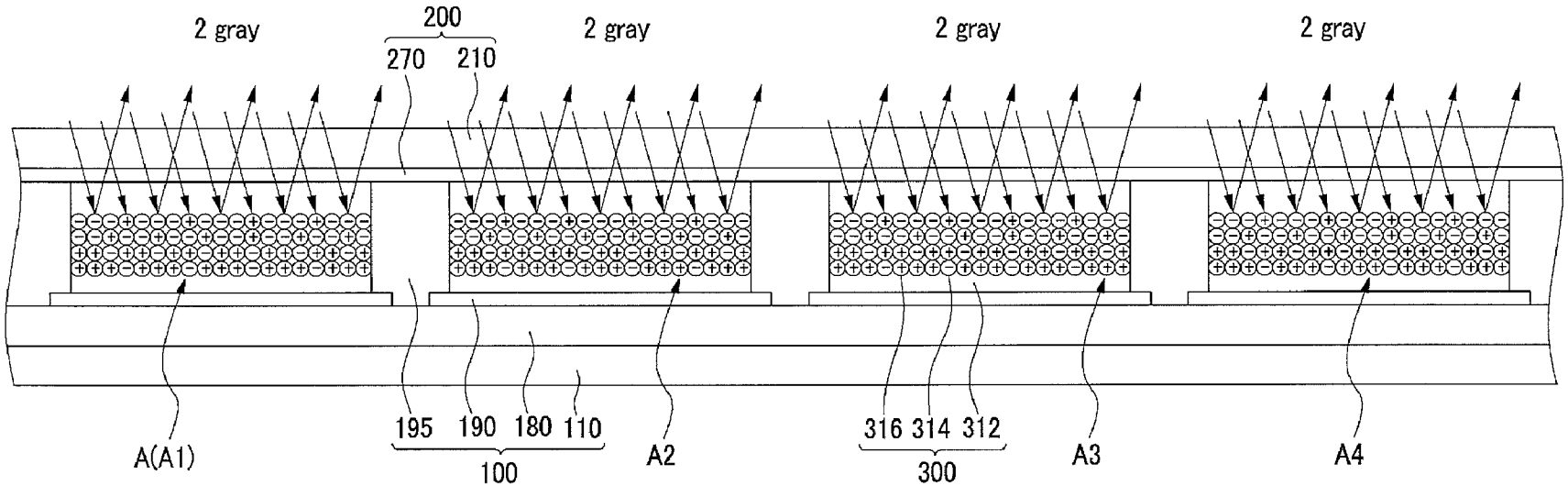
FIG. 14 is a cross-sectional view showing the movement of the electrophoretic particles disposed in four pixels after the passage of the eighth time of FIG. 5.
Figure 15:
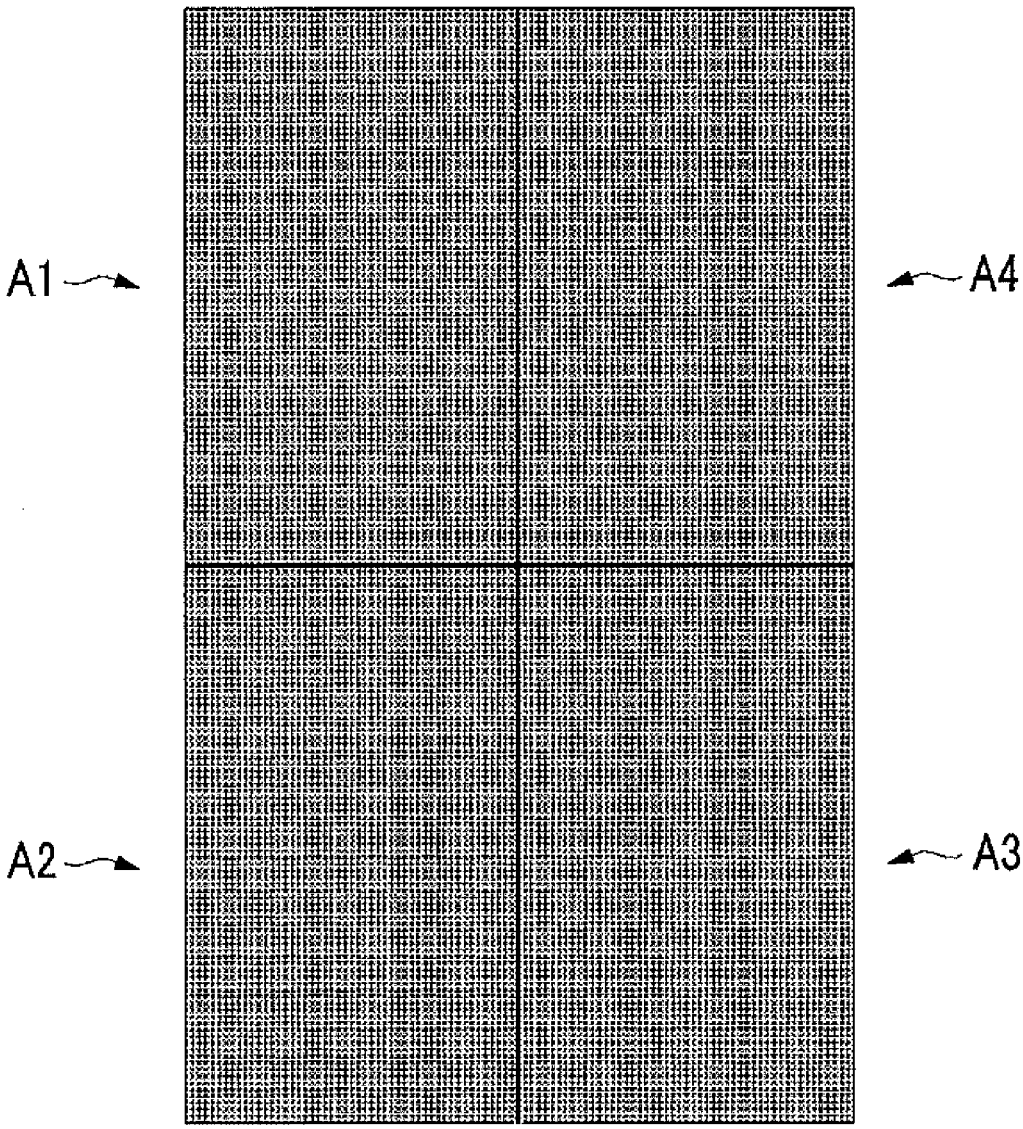
FIG. 15 is a view showing the images of four neighboring pixels in the electrophoretic display of FIG. 14.
Figure 16:
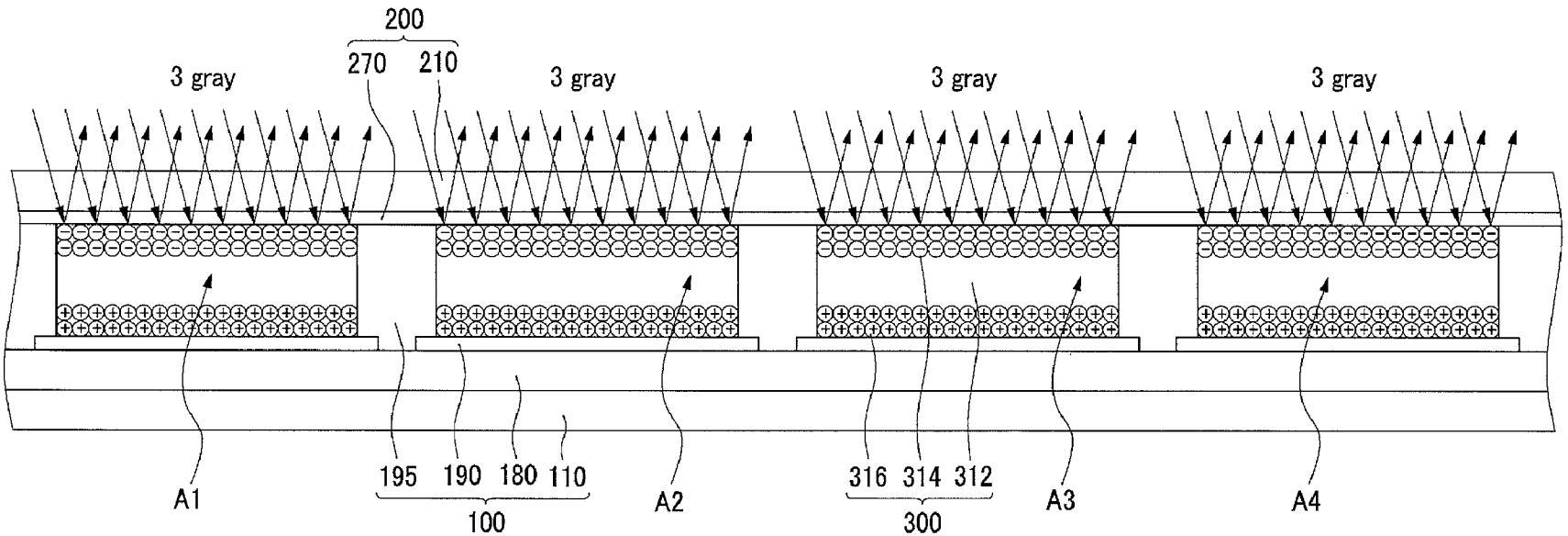
FIG. 16 is a cross-sectional view showing the movement of the electrophoretic particles disposed in four pixels after the passage of the ninth time of FIG. 5.
Figure 17:
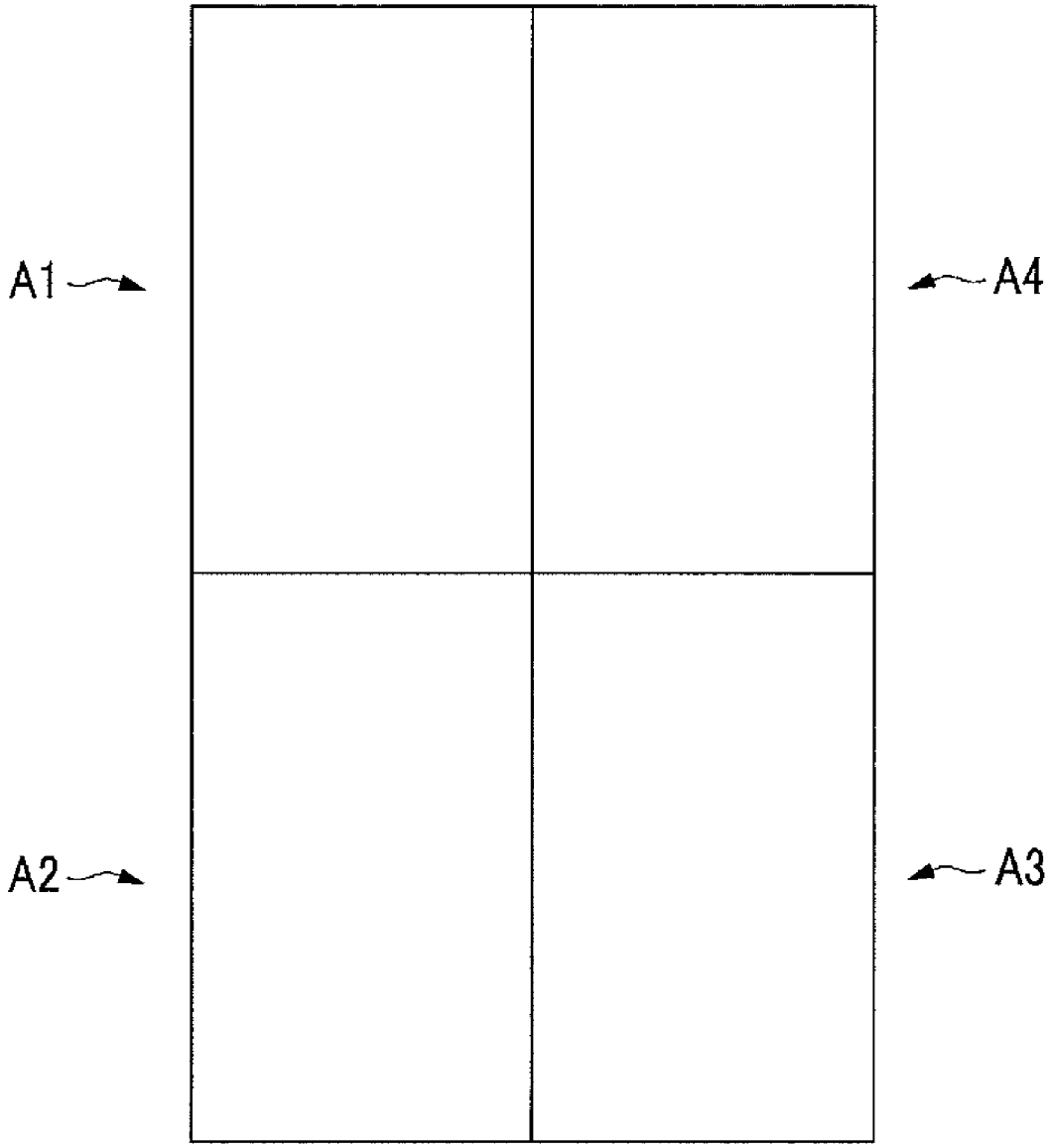
FIG. 17 is a view showing the images of four neighboring pixels in the electrophoretic display of FIG. 16.

FIG. 5 is a view showing driving voltages applied to the electrophoretic particles disposed in the four neighboring pixels by time to explain a method for driving an electrophoretic display according to an exemplary embodiment of the present invention, FIG. 6 is a cross-sectional view showing the movement of the electrophoretic particles disposed in four pixels after the passage of the first time of FIG. 5, and FIG. 7 is a view showing the images of four neighboring pixels in the electrophoretic display of FIG. 6. FIG. 8 is a cross-sectional view showing the movement of the electrophoretic particles disposed in four pixels after the passage of the second time of FIG. 5, and FIG. 9 is a view showing the images of four neighboring pixels in the electrophoretic display of FIG. 8, FIG. 10 is a cross-sectional view showing the movement of the electrophoretic particles disposed in four pixels after the passage of the fifth time of FIG. 5, and FIG. 11 is a view showing the images of four neighboring pixels in the electrophoretic display of FIG. 10. FIG. 12 is a cross-sectional view showing the movement of the electrophoretic particles disposed in four pixels after the passage of the sixth time of FIG. 5, FIG. 13 is a view showing the images of four neighboring pixels in the electrophoretic display of FIG. 12, FIG. 14 is a cross-sectional view showing the movement of the electrophoretic particles disposed in four pixels after the passage of the eighth time of FIG. 5, and FIG. 15 is a view showing the images of four neighboring pixels in the electrophoretic display of FIG. 14. FIG. 16 is a cross-sectional view showing the movement of the electrophoretic particles disposed in four pixels after the passage of the ninth time of FIG. 5, and FIG. 17 is a view showing the images of four neighboring pixels in the electrophoretic display of FIG. 16.

The various driving voltages result from the difference between the data voltages applied to the pixel electrodes and the common voltage applied to the common electrode. With regard to FIG. 5, these voltages are defined as follows:

A reset voltage is an image display voltage V2 having a negative level so that the first electrophoretic particles 314 may overcome fluid resistance of the transparent dielectric fluid 312 and move toward the pixel electrode 190, and so that the second electrophoretic particles 316 may overcome the fluid resistance of the transparent dielectric fluid 312 and move toward the common electrode 270.

A reset compensation voltage is a final compensation voltage V1 having a positive level so that the first electrophoretic particles 314 may overcome the fluid resistance of the transparent dielectric fluid 312 and move toward the common electrode 270, and so that the second electrophoretic particles 316 may overcome the fluid resistance of the transparent dielectric fluid 312 and move toward the pixel electrode 190. The reset compensation voltage has substantially the same magnitude as the reset voltage and the image display voltage, but of an opposite polarity.

A middle gray display voltage V1 or V2 is a voltage having a positive or negative level to display a gray image so that the first electrophoretic particles 314 may overcome the fluid resistance of the transparent dielectric fluid 312 and move toward the pixel electrode 190 or common electrode 270, and so that the second electrophoretic particles 314 may overcome the fluid resistance of the transparent dielectric fluid 312 and move in an opposite direction to the movement direction of the first electrophoretic particles 314. The middle gray display voltage has substantially the same magnitude as the reset voltage, the image display voltage, and the reset compensation voltage, or the final compensation voltage.

The time for applying the various driving voltages V1 and V2 is defined, with regard to FIG. 5. Each application time T1, T2, T3, etc., is denoted by a respective Arabic numeral, The application time having a low numeral is not necessarily longer, nor does it necessarily precede the application time having a larger numeral.

A first time T1 is the application time of the reset voltage to display the image of a zero gray in which the first electrophoretic particles 314 and the second electrophoretic particles 316 respectively move and are disposed similarly to that of the electrophoretic particles 314 and 316 in the fourth pixel A4 of FIG. 3, such that the corresponding pixel is in a lowest gray.

A second time T2 is an application time of the reset compensation voltage to display the image of the third gray in which the first electrophoretic particles 314 and the second electrophoretic particles 316, that have been in the same arrangement as that of the fourth pixel A4 in FIG. 3, move as that of the first pixel A1 in FIG. 3 such that the corresponding pixel is in a highest gray. The second time has substantially the same length as the first time T1.

A fifth time T5 is an application time of the image display voltage to display the image of a zero gray in which the first electrophoretic particles 314 and the second electrophoretic particles 316, that have been in the same arrangement as that of the first pixel A1 in FIG. 3, move to the same arrangement as that of the fourth pixel A4 in FIG. 3 such that the corresponding pixel is in the lowest gray. The fifth time has substantially the same length as the first time T1.

A third time T3 is an application time of the image display voltage to display the image of the second gray in which the first electrophoretic particles 314 and the second electrophoretic particles 316, that have been in the same arrangement as that of the first pixel A1 in FIG. 3, move to the same arrangement as that of the second pixel A2 in FIG. 3 such that the corresponding pixel is in a second gray. The third time substantially has a length of about ⅓ that of the fifth time T5.

A fourth time T4 is an application time of the image display voltage to display the image of the first gray in which the first electrophoretic particles 314 and the second electrophoretic particles 316, that have been in the same arrangement as that of the first pixel A1 in FIG. 3, move to the same arrangement as that of the third pixel A3 in FIG. 3 such that the corresponding pixel is in a first gray. The fourth time substantially has a length of about ⅔ that of the fifth time T5.

A sixth time T6 is an application time of the image display voltage with a middle gray of a negative level to display the image of the first gray in which the first electrophoretic particles 314 and the second electrophoretic particles 316, that have been in the same arrangement as that of the first pixel A1 in FIG. 3, move to the same arrangement as that of the second pixel A2 in FIG. 3 such that the corresponding pixel is in the first gray. The sixth time has substantially the same length as the third time T3.

A seventh time T7 is an application time of the image display voltage with a middle gray of a positive level in which the first electrophoretic particles 314 and the second electrophoretic particles 316, that have been in the same arrangement as that of the third pixel A3 in FIG. 3, move to the same arrangement as that of the second pixel A2 in FIG. 3 such that the corresponding pixel is in the first gray. The seventh time has substantially the same length as the third time T3.

A eighth time T8 is an application time of the image display voltage with a middle gray of a positive level in which the first electrophoretic particles 314 and the second electrophoretic particles 316, that have been in the same arrangement as that of the fourth pixel A4 in FIG. 3, move to the same arrangement as that of the second pixel A2 in FIG. 3 such that the corresponding pixel is in the first gray. The eighth time has substantially the same length as the fourth time T4.

A ninth T9 is an application time of the final compensation voltage to display the third gray in which the first electrophoretic particles 314 and the second electrophoretic particles 316, that have been in the same arrangement as that of the fourth pixel A4 in FIG. 3, move to the same arrangement as that of the first pixel A1 in FIG. 3 such that the corresponding pixel is in the highest gray. The ninth time has substantially the same length as the third time T3.

Ta, Tb, Td, Te are time intervals in which the various voltages V1 and V2 are not applied. They may be arbitrarily set to be the same or different, or may be omitted.

Tc is the time interval in which the various driving voltages are not applied to maintain the image that each corresponding pixel has displayed through the application of the reset compensation voltage or the image display voltage.

In a driving method of the electrophoretic display according to an exemplary embodiment of the present invention, as shown in FIG. 5, the reset voltage V2 is applied during the first time T1 to all of the first to fourth pixels A1, A2, A3, and A4. The first electrophoretic particles 314 respectively disposed in all of the first to fourth pixels A1, A2, A3, and A4 move to the pixel electrode 190, The second electrophoretic particles 316 move to the common electrode 270, as shown in FIG. 6. Accordingly, as shown in FIG. 7, all of the first to fourth pixels A1, A2, A3, and A4 display the images of zero gray as the lowest gray.

Next, as shown in FIG. 5, during the second time T2 after the passage of the first time T1 and the predetermined time Ta, the reset compensation voltage V1 is applied to the first to fourth pixels A1, A2, A3, and A4. As shown in FIG. 8, the first electrophoretic particles 314 move toward the common electrode 270. The second electrophoretic particles 316 move toward the pixel electrode 190. Then, as shown in FIG. 9, the first to fourth pixels A1, A2, A3, and A4 display the images of the third gray which is the highest gray. Because the values that the reset voltage V2 is integrated over the first time T1 is substantially the same as the value that the reset compensation voltage V1 is integrated over the second time T2 which is the same duration as application time T1, each pixel A is refreshed and the stimulated charges are removed by the reset voltage V2.

Next, as shown in FIG. 5, during the third to fifth times T3, T4, and T5 after the passage of the second time T2 and the predetermined time Tb, the image display voltage V2 is applied to the second to fourth pixels A2, A3, and A4 to display the desired images. At this time, the image display voltage V2 is not applied to the first pixel A1.

Therefore, the first electrophoretic particles 314 and the second electrophoretic particles 316 respectively disposed in the first to fourth pixels A1, A2, A3, and A4 are arranged as shown in FIG. 10. As shown in FIG. 11, the first pixel A1 displays the third gray image as the highest gray, and the second pixel A2 displays the second gray image which is darker than the third gray. Also, the third pixel A3 displays the first gray image which is darker than the second gray, and the fourth pixel A4 displays a zero gray image as the lowest gray.

In the present exemplary embodiment, for convenience of explanation, the first to fourth pixels A1, A2, A3, and A4 respectively display the images of the third gray, the second gray, the first gray, and the zero gray. However, the first to fourth pixels A1, A2, A3, and A4 may display the arbitrary image of each gray among the zero gray to the third gray images.

The images of the desired gray are displayed in each of the first to fourth pixels A1, A2, A3, and A4 through the application of the image display voltage V2 during the image maintaining time Tc.

Next, as shown in FIG. 5, during the sixth time T6 after the passage of the image maintaining time Tc, the display voltage V2 of the middle gray with a negative level is applied to the first pixel A1. During the seventh time T7 and the eighth time T8, respectively, the display voltage V1 of a middle gray with a positive level is applied to the third and the fourth pixels A3 and A4. The display voltage with a middle gray is not applied to the second pixel A2.

The first electrophoretic particles 314 and the second electrophoretic particles 316 respectively disposed in the first to fourth pixels A1, A2, A3, and A4 are respectively rearranged as shown in FIG. 12 after the passage of the sixth time T6. Unlike FIG. 10, the arrangements of the electrophoretic particle 314 and 316 disposed in the first pixel A1 and the fourth pixel A4 are changed. By these arrangements, as shown in FIG. 13, the first pixel A1 and the second pixel A2 respectively display the images of the second gray that is darker than the third gray, and the third pixel A3 and the fourth pixel A4 display the images of the first gray that is darker than the second gray. That is to say, unlike FIG. 11, the first pixel A1 changes from the third gray into the image of the second gray, and the fourth pixel A4 changes from the zero gray into the image of the first gray.

After the passage of the eighth time T8, the first electrophoretic particles 314 and the second electrophoretic particles 316 respectively disposed in the first to fourth pixels A1, A2, A3, and A4 are respectively rearranged as shown in FIG. 14. That is, unlike FIG. 12, the arrangements of the electrophoretic particles 314 and 316 disposed in the third pixel A3 and the fourth pixel A4 are changed. According to these arrangements, as shown in FIG. 15, all of the first to fourth pixels A1, A2, A3, and A4 display the images of the second gray. That is to say, unlike FIG. 13, the third pixel A3 and the fourth pixel A4 are respectively changed from the first gray into the images of the second gray.

Next, during the ninth time T9 after the passage of the eighth time T8 and the predetermined time Td, the final compensation voltage V1 is applied to the first to fourth pixels A1, A2, A3, and A4.

Accordingly, the electrophoretic particles 314 and 316 disposed in the first to fourth pixels A1, A2, A3, and A4 are rearranged as shown in FIG. 16. That is, unlike FIG. 14, the arrangements of the electrophoretic particles 314 and 316 disposed in the first to fourth pixels A1, A2, A3, and A4 are all changed. According to these arrangements, as shown in FIG. 17, all of the first to fourth pixels A1, A2, A3, and A4 display the images of the third gray. That is to say, unlike FIG. 15, the first to fourth pixels A1, A2, A3, and A4 are all changed from the second gray into the third gray.

According to the driving method of the electrophoretic display according to an exemplary embodiment of the present invention, the first pixel A1, the third pixel A3, and the fourth pixel A4 are smoothly changed into the same image as the image of the first gray that is displayed in the second pixel A2 without the display of the reversed image through the application of the image display voltage, the middle gray display voltage, and the final compensation voltage, as shown in FIG. 11, FIG. 13, FIG. 15, and FIG. 17. Accordingly, the user's eye does not receive the burden in the driving process of the electrophoretic display.

Also, the value of the middle gray display voltage V2 of a negative level that is integrated with the sixth time T6 corresponding to the application time is the same as the value of the final compensation voltage V2 that is integrated with the ninth time T9 corresponding to the application time in the case of the first pixel A1, the value of the image display voltage V2 that is integrated with the third time T3 corresponding to the application time is the same as the value of the final compensation voltage V2 that is integrated with the ninth time T9 corresponding to the application time in the case of the second pixel A2, the value of the image display voltage V2 that is integrated with the fourth time T4 corresponding to the application time is the same as the sum of the value of the middle gray display voltage V1 with a positive level that is integrated with the seventh time T7 corresponding to the application time and the value of the final compensation voltage V2 that is integrated with the ninth time T9 corresponding to the application time in the case of the third pixel A3, and the value of the image display voltage V2 that is integrated with the fifth time T5 corresponding to the application time is the same as the sum of the value of the middle gray display voltage V1 with a positive level that is integrated with the eighth time T8 corresponding to the application time and the value of the final compensation voltage V2 that is integrated with the ninth time T9 corresponding to the application time in the case of the fourth pixel A4.

Accordingly, the first to fourth pixels A1, A2, A3, and A4 are refreshed from the image display voltage to the final compensation voltage such that the stimulated charges in the process of the application of the image display voltage and the middle gray display voltage are removed. Therefore, the display performance of the electrophoretic display may be improved.

Also, the electrophoretic particles 314 and 316 disposed in the first to fourth pixels A1, A2, A3, and A4 and having the arrangement of FIG. 14 through the application of the middle gray display voltage receive the final compensation voltage only during the ninth time T9 as a short time to move into the arrangement of FIG. 16. Accordingly, the display speed may be improved in the entire driving process of the electrophoretic display.

On the other hand, the middle gray display voltage and the final compensation voltage are repeatedly applied again after the passage of the predetermined time Te for the desired image and the compensation drive for the prevention of the afterimage of the image display voltage.

Differently from the above-described exemplary embodiment of the present invention, the various driving voltages V1 and V2 and the application time of the corresponding voltages V1 and V2 may also be changed in the conditions for satisfying the refreshing of each pixel A.

Also, differently from the driving method of the electrophoretic display according to an exemplary embodiment of the present invention, a reset voltage having an opposite polarity to that of the reset voltage V2 and the same magnitude as the reset voltage V2 may be applied instead of the application of the reset voltage V2 to the electrophoretic particles 314 and 316 disposed in the first to fourth pixels A1, A2, A3, and A4 during the first time T1 such that the first to fourth pixels A1, A2, A3, and A4 may not display the zero gray but may display the image of the third gray. In this case, the various driving voltages V1 and V2 that are applied each time are changed into driving voltages having an opposite polarity and the same magnitude.

Further, the electrophoretic layer 300 of the electrophoretic display may only include the transparent dielectric fluid 312 with a black color and electrophoretic particles 314 with a white color, and the same effects may be obtained through the same driving method as in the exemplary embodiments of the present invention.

Also, the first electrophoretic particles 314 may have one color of red, green, and blue instead of white to display images with the various colors of the electrophoretic display. In this case, the first electrophoretic particles 314 sequentially and respectively having one of red, green, and blue colors may be disposed in the transparent dielectric fluid 312 along with the second electrophoretic particles 316 with a black color in each pixel A. On the other hand, the first electrophoretic particles 314 may have one of yellow, magenta, and cyan instead of red, green, and blue.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

As above-described, according to the method for driving the electrophoretic display of the present invention, the images are smoothly changed in the refresh process of the pixel electrode for the prevention of the afterimage, thereby improving the display performance of the electrophoretic display.

What is claimed is:

1. A method for driving an electrophoretic display, comprising:

applying an image display voltage comprising a predetermined magnitude to display one gray of at least three different grays to at least a portion of a plurality of pixels;

applying a middle gray display voltage comprising a predetermined magnitude to display the same middle grays to at least a portion of the plurality of pixels; and applying a final compensation voltage comprising a predetermined voltage to refresh the plurality of pixels, wherein a magnitude of a time-integrated value of the image display voltage is substantially the same as a magnitude of a sum of a time-integrated value of the middle gray display voltage and the final compensation voltage for the portion of the pixels.

2. The method of claim 1, further comprising, before applying the image display voltage, applying a reset voltage to the plurality of pixels, and applying a reset compensation voltage comprising an opposite polarity to that of the reset voltage to the plurality of pixels.

3. The method of claim 2, further comprising applying an interval of maintaining images displayed in the plurality of pixels between the applying the image display voltage and the applying the middle gray display voltage.

4. The method of claim 3, wherein a magnitude of a time-integrated value of the image display voltage is substantially the same as a magnitude of a time-integrated value of the final compensation voltage for the rest of the pixels.

5. The method of claim 4, wherein the middle gray display voltage and the final compensation voltage have opposite polarities to that of the image display voltage for the pixel being applied with an image display voltage.

6. The method of claim 5, wherein, a magnitude of a time-integrated value of the middle gray display voltage is substantially the same as a magnitude of a time-integrated value of the final compensation voltage for the pixel not being applied with the image display voltage.

7. The method of claim 6, wherein, the final compensation voltage has an opposite polarity to that of the middle gray display voltage for the pixel not being applied with the image display voltage.

8. The method of claim 2, wherein the plurality of pixels:

respectively display the image of the lowest gray through the application of the reset voltage, respectively display the image of the highest gray through the application of the reset compensation voltage, and respectively display the image of at least one of the lowest gray, the highest gray, and an intermediate gray that is between the lowest gray and the highest gray through the application of the image display voltage.

9. The method of claim 8, wherein the plurality of pixels respectively display one gray of the lowest gray, a first intermediate gray, a second intermediate gray that is higher than the first intermediate gray, and the highest gray through the application of the image display voltage, the applying time of the reset voltage is a first time to display the image of the lowest gray in the plurality of pixels, the applying time of the reset compensation voltage is a second time to display the image of the highest gray in the plurality of pixels, the applying time of the image display voltage is a third time to a fifth time, the applying time of the middle gray display voltage is a sixth time to an eighth time, and the applying time of the final gray display voltage is a ninth time.

10. The method of claim 9, wherein the lengths of the second time and the fifth time are substantially the same as the length of the first time.

11. The method of claim 10, wherein the lengths of the third time and the fourth time are respectively one-third and two-thirds of the length of the fifth time.

12. The method of claim 11, wherein the lengths of the sixth time, the seventh time, and the ninth time are substantially the same as the length of the third time, and the length of the eighth time is substantially the same as the length of the fourth time.

13. The method of claim 12, wherein at least a portion of the plurality of pixels are applied with the middle gray display voltage during the seventh time after the sixth time.

14. The method of claim 13, wherein the pixels displaying the image with the highest gray for applying the interval of maintaining the images display the image of the second intermediate gray after the passage of the sixth time.

15. The method of claim 14, wherein the pixels respectively displaying the images with the first and second intermediate grays for applying the interval of maintaining the images respectively display the images with the first and second intermediate grays after the passage of the sixth time.

16. The method of claim 15, wherein the pixels displaying the image with the first middle gray for applying the interval of maintaining the images display the images with the second intermediate gray after the passage of the seventh time.

17. The method of claim 16, wherein the pixels displaying the image with the lowest gray for applying the interval of maintaining the images display the images with the first intermediate gray after the passage of the sixth time, and display the image with the second intermediate gray after the passage of the eighth time.

18. The method of claim 17, wherein the plurality of pixels display the images with the highest gray after the passage of the ninth time.

19. The method of claim 1, wherein the plurality of pixels display an image of a lowest or a highest gray by applying the final compensation voltage.

20. A method of driving an electrophoretic display comprising:

during a first time interval (T1), applying to a plurality of pixels display a reset voltage causing the pixels to display images of a lowest gray value;

during a succeeding time interval (T2), applying to the pixels a reset compensation voltage that has opposite polarity to the reset voltage, causing the pixels to display images of a highest gray value;

during each of three succeeding different length time intervals (T3, T4 and T5), causing each of the pixels to display a respective gray ranging from zero gray to highest gray;

during a succeeding image maintaining time (Tc) following the longest one of the time intervals (T3, T4 and T5), causing the images of the desired gray to be displayed in each of the pixels;

following the image maintaining time (Tc), causing each of the pixels for a respective time interval (T6, T7 and T8) to display a gray value different from the gray value displayed during the different length time intervals (T3, T4 and T5); and during a final time interval following the longest of the respective time intervals, causing all of the pixels to display the highest gray value.

* * * * *